US007624966B2

(12) United States Patent
Dando et al.

(10) Patent No.: US 7,624,966 B2
(45) Date of Patent: Dec. 1, 2009

(54) MANUAL ASSIST AND METHOD FOR OPENING SLIDING WINDOWS AND DOORS

(76) Inventors: Kerrick R. Dando, 4611 Northridge Ct., Murrysville, PA (US) 15668; Neal R. Dando, 4611 Northridge Ct., Murrysville, PA (US) 15668; M. Jonell Kerkhoff, 4611 Northridge Ct., Murrysville, PA (US) 15688

( * ) Notice: Subject to any disclaimer, the term of this patent is extended or adjusted under 35 U.S.C. 154(b) by 246 days.

(21) Appl. No.: 11/699,298

(22) Filed: Jan. 29, 2007

(65) Prior Publication Data

US 2008/0178534 A1 Jul. 31, 2008

(51) Int. Cl.
*B66F 3/00* (2006.01)

(52) U.S. Cl. ..... 254/131; 254/120

(58) Field of Classification Search ..... 254/131, 254/113–119, 120, 130, DIG. 3
See application file for complete search history.

(56) References Cited

U.S. PATENT DOCUMENTS

| | | | | |
|---|---|---|---|---|
| 1,960,255 | A * | 5/1934 | Tyroff | 254/130 |
| 2,010,680 | A * | 8/1935 | Van Leuven | 254/131 |
| 4,830,338 | A * | 5/1989 | Hannigan | 254/130 |
| 5,775,674 | A * | 7/1998 | Bigham | 254/131 |
| 6,170,803 | B1 * | 1/2001 | Liberfarb | 254/131 |
| 6,354,570 | B1 * | 3/2002 | Christensen et al. | 254/131 |
| 6,520,482 | B1 * | 2/2003 | Bigham | 254/131 |
| 2003/0085390 | A1 * | 5/2003 | Bigham | 254/131 |
| 2008/0178534 | A1 * | 7/2008 | Dando et al. | 49/506 |

* cited by examiner

*Primary Examiner*—Lee D Wilson
(74) *Attorney, Agent, or Firm*—Gary P. Topolosky

(57) ABSTRACT

There is disclosed a manual assist for opening a window, door or other mechanism that slides in a preset track. The manual assist comprises an elongated, preferably contoured handle; a wedge near one end of the handle; and a base pivotally mounted to the handle near the wedge end. Preferably, this manual assist may be hung near a window using a Velcro® strip pair, aperture or hook when not in use.

12 Claims, 6 Drawing Sheets

MANUAL ASSIST AND METHOD FOR OPENING SLIDING WINDOWS AND DOORS

BACKGROUND OF THE INVENTION

1. Field of the Invention

The present invention relates to devices for assisting the elderly, arthritic, handicapped, disabled or those with impaired manual dexterity with daily chores. More particularly, this invention relates to an assist for manually opening sliding windows and doors with less physical force.

2. Description of Related Art

As the population ages and people live longer lives, some of the common chores we take for granted may be difficult for seniors, those with muscular deficiencies and/or other handicaps or disabilities, to perform. For example, the mere exertion of a wrist turn to open a jar or bottle, many have no difficulties performing. But there is a growing market for providing "assists" to those needing a little extra help with day-to-day activities.

A representative example of such assisting means can be seen in Bergeron U.S. Pat. No. 7,080,752. There, a drinking container was disclosed which requires a reduced degree of tilt for assisting the disabled in drinking fluids from same.

In Phillips U.S. Pat. No. 6,385,797, an interesting mechanism is shown for assisting the handicapped in raising and/or lowering their own toilet seat.

When visiting an older relative, it was observed the difficulties she was having in opening a standard sliding window in her apartment. Regardless of wind conditions and/or pressure differences between the in and outdoors, a lot of exertion was needed for leveraging the window to open same. Most windows and sliding doors that seal create an air lock that must be "broken" before the mechanism (window or door) can be easily moved about. It was observed that she had much less difficulty closing that window once opened. At one of the windows in her same apartment, a long monkey wrench was seen nearby as an awkward, potentially dangerous device for assisting her window opening efforts. The wrench was heavy, awkward to manipulate and raised the possibility of doing substantial damage to the frame surrounding the window proper.

A genuine need exists for a manual assist that would allow seniors, the disabled and those with reduced hand or arm strength for any reason to more effectively open their own sliding doors and windows, i.e. structural mechanisms that slide back and forth, typically in a horizontal or vertical plane, in their own, pre-assigned sliding tracks. With this invention, a device that is both aesthetically pleasing and strong assists the less fortunate with respect to this one daily chore. And with a proper fulcrum configuration, the elongated, contoured handle of this invention can swivel back and forth about its securing base that preferably includes a thick felt or other non-marking bottom portion so as to reduce the likelihood of damage to window and/or door frame surrounds.

Other objects and features of the present invention will be obvious to those of skill in the art. It should be noted, however, that the drawings are designed for the purpose of illustration only and not as a definition of the limits of the instant invention, for which reference should be made to the claims appended hereto.

SUMMARY OF THE INVENTION

There is disclosed a manual assist for opening a window, door or other mechanism that slides in a preset track. The manual assist comprises an elongated handle that is preferably contoured and, more preferably, telescopically adjustable in length; a wedge near one end of that handle; and a base pivotally mounted to the handle near the wedge end. Preferably, this manual assist may be hung nearby using a Velcro® strip pair, aperture or hook when not in use. Should a hook or other handle configuration be added to or otherwise incorporated in the assist opposite the wedge end, the hook or handle can be used to either push the window or door even further open, or alternately pull the opened window or door closed.

BRIEF DESCRIPTION OF THE DRAWINGS

Further features, objectives and advantages of the present invention will become clearer when referring to the following detailed description of preferred embodiments made with reference to the accompanying drawings in which.

DESCRIPTION OF PREFERRED EMBODIMENTS

Figure 1:
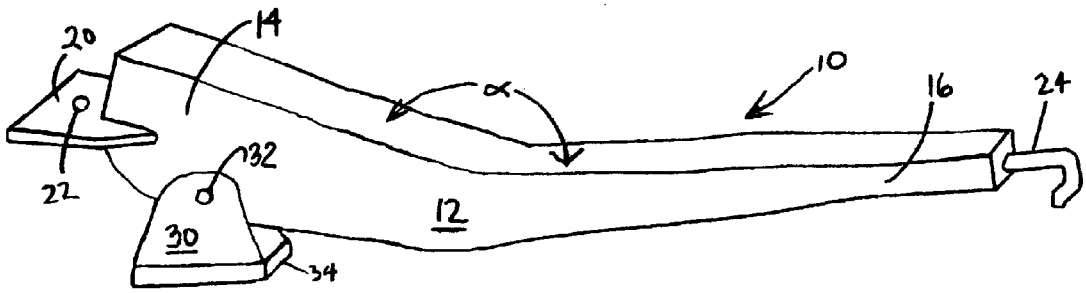
FIG. 1 is front perspective view of one embodiment of the manual opener assist according to the invention.

Referring now to FIGS. 1 through 5, there is shown a preferred embodiment of manual assist, generally item 10, according to this invention. The assist has an elongated handle portion 12. Preferably that handle is intentionally contoured for easy use. It may further include optional gripping means made of plastic or rubber (not shown), or pre-carved or molded recesses for the operator's fingers to readily fit into. In one embodiment, handle 12 is made from solid oak, though it is to be understood that other models may be made from wood, metals, including stainless steel and/or aluminum, or a sturdy enough grade of plastic or polymer. Arguably, handle 12 could also be made from composites, glass and/or ceramics. While not shown, it is to be understood that handle 12 may be purposefully sectionalized so as to telescopically extend or retract at least partially into itself For the latter embodiments, a screw-type adapter may be employed to keep the handle extended to its preferred user length.

In one preferred embodiment, handle 12 has a preset bevel or angle. The latter divides the body proper of handle 12 into a window/door positioning end 14 and an operator end 16. One preferred angle of incline, angle $\alpha$ in FIG. 1 between the two ends is less than about 30 degrees, or more preferably between about 1 to 15 degrees, offset from the plane P on which the base of manual assist 10 otherwise rests. To a lesser degree, one may construct and employ an alternate manual assist whose handle has no bevel/angle.

One embodiment of wedge 20 used with the manual assist 10 has a square, rectangular or trapezoidal shape. It is made from a section of hard polymer or plastic (e/g. a polycarbonate). Such a wedge construction would be relatively inexpensive to make, yet not scratch the surfaces it repeatedly contacts (the window or door frame). A polycarbonate (or other plastic) wedge would also tend to break under excessive pressure (as when being used against a fully locked window or door) rather than cause possible damage to that inadvertently still-locked window, door or the frames for same.

Alternately, wedge 20 can be made from graphite, wood, ceramic or a coated metal, such as aluminum or steel. As shown, wedge 20 is positioned at the far tip of positioning end 14. Wedge 20 can be glued, bolted, press-fit, welded or otherwise secured substantially near that end so as to overlap the handle 12 by a needed amount. Alternatively, the wedge can be made of the same material as the handle so that the handle and wedge are a single piece. Either way, wedge 20 should have sufficient rigidity to withstand the forces of repeatedly being leveraged back and forth to open various sliding glass doors and/or windows in their respective tracks. As shown in FIG. 1, wedge 20 has an optional aperture 22 for hanging the device on a hook in the wall when not in use. An alternate hanging/storage means, hook 24, is shown on the opposite end of handle 12. It is to be understood, however, that the size, shape and/or location of these storage means are possible to situate in various locations. They can also be made integral with the handle proper depending on the material selected to make, cast, mold and/or carve same. Should a more integral hook shape be incorporated in the overall design of this invention, the device can be readily flipped about in order to use the opposite, "hook" end for further opening a window or door . . . or for closing the opened window or door, either by pushing OR pulling with the integral hook end.

A combination of Velcro® hook and loop strips can also be used for storage. One strip of tape can be affixed to the handle (not shown) and its matching counterpart at or near the window frame for which the device is needed/used most often.

An alternate embodiment of wedge (not shown) can consist of a coated metal band. Should that band be box-shaped, triangular or rectagonal, it can be affixed to the positioning end 14 of handle 12 for repeatedly wedging against the sliding window/door frame to be opened. That same band can also serve as an alternate storage means for hanging on a wall hook or the like when not in use.

Figure 2:
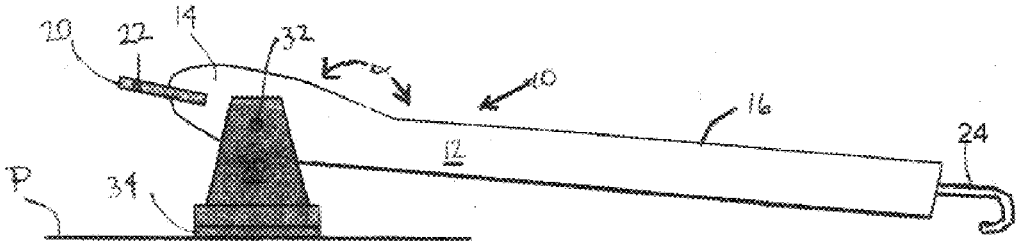
FIG. 2 is a side view of the manual assist of FIG. 1.
Figure 3:
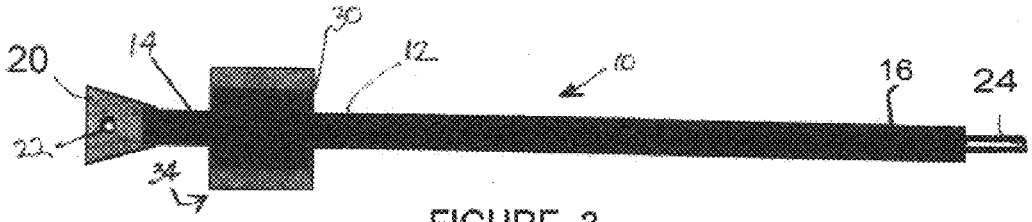
FIG. 3 is a top view of the manual assist of FIG. 1.

The base 30 to the manual assist should be pivotally mounted near the positioning end 14 of handle 12. As shown in FIGS. 1 through 3, a preferred base 30 is made from the same material as handle 12 for better aesthetics. Base 30 attaches to and through handle 12 with a swiveling bolt, washer and nut or retaining ring combination 32. Alternately, both handle 12 and base 30 can be made from the same metal, wood, ceramic, polymer and/or plastic materials, or from complementary combinations of same. As shown, base 30 includes a lowermost bottom cushion 34, of felt, cork, plastic, rubber or other suitable materials. This cushion 34 will repeatedly contact the wall frame adjacent the sliding door or window to be opened with the invention and serve to prevent any damage to that wall frame with repeated uses of the manual assist. Should the base be made from plastic, or wood it is possible to avoid adding a separate cushion end to base 30.

Figure 4:
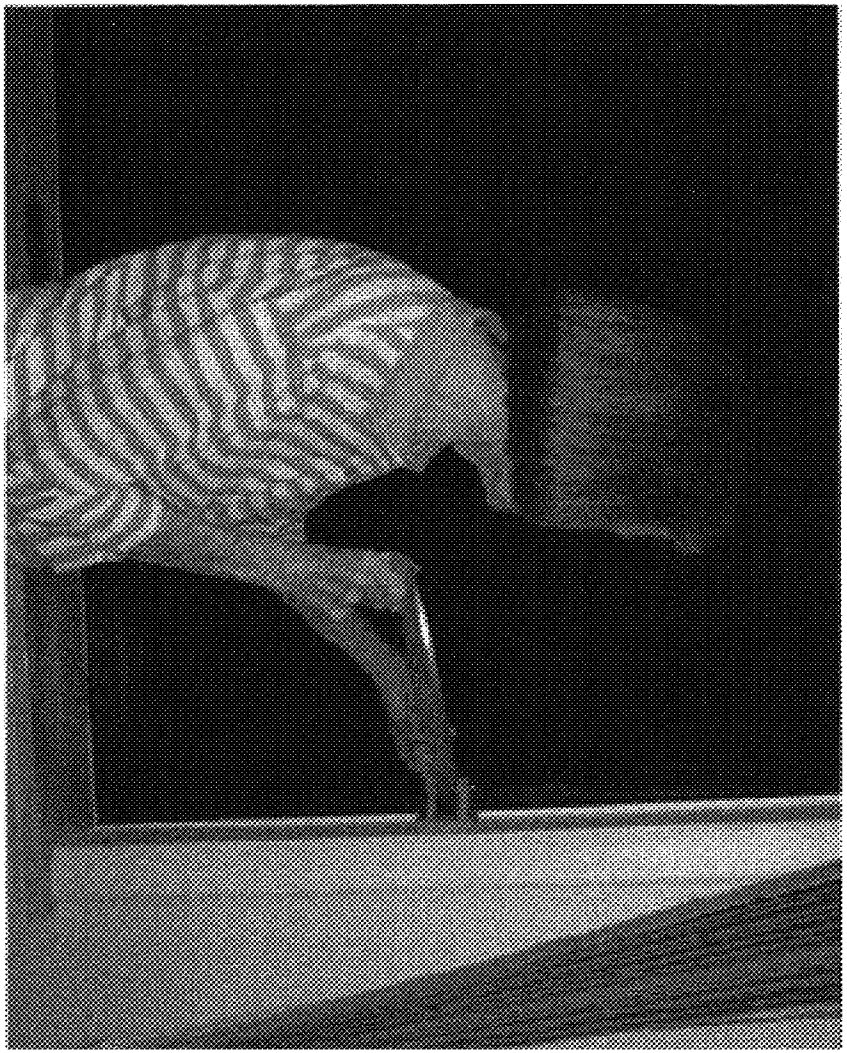
FIG. 4 is a photograph showing an operator positioning the manual assist to open a sliding window.
Figure 5:
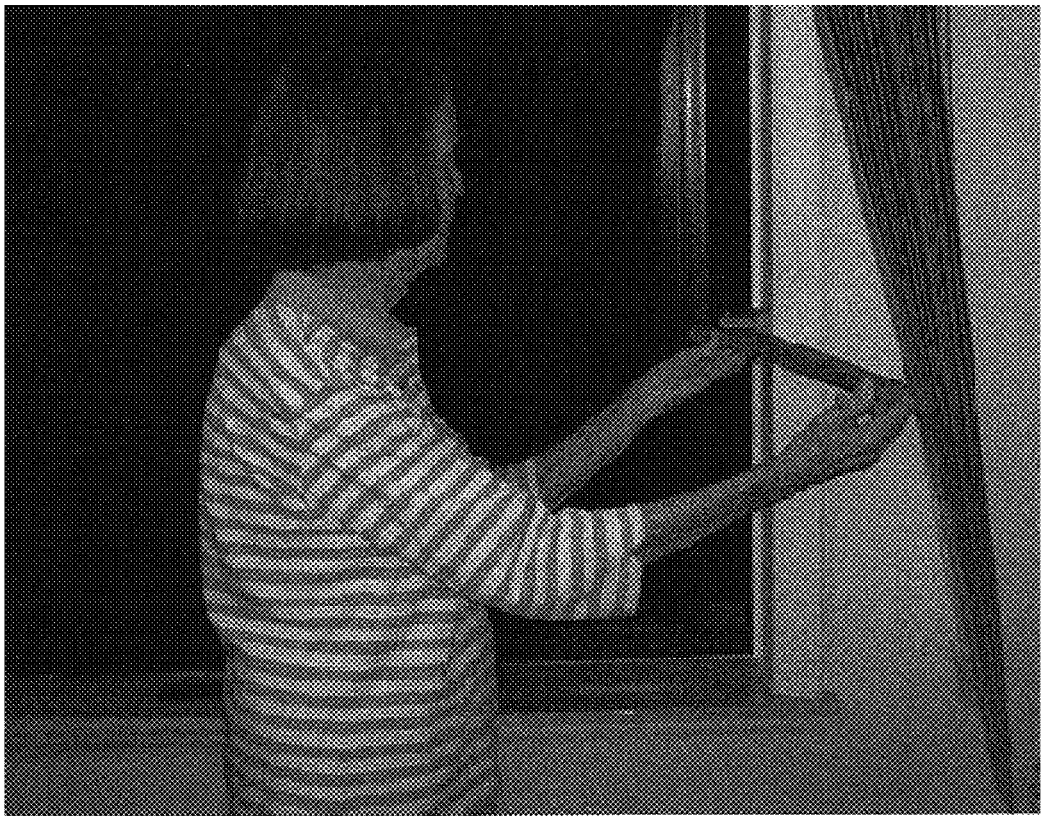
FIG. 5 is a photograph showing the FIG. 4 operator levering the manual assist to open the window using less physical exertion.

In order to best illustrate the proper use of this invention, an operator was positioning the device in accompanying FIGS. 4 and 5. First, she aligned the wedge end with the edge of a horizontally-opening window (alternately, against the sliding door edge). Should the particular window or door design include a handle recess, the manual assist wedge can be positioned against same. After the wedge of the manual assist is properly positioned, its base should be rested against an area of the wall frame surrounding the window or door to be opened. Thereafter, the air seal of the window or door is technically broken by pushing against the handle portion of this invention. In accompanying FIGS. 4 and 5, that translates to moving the handle portion of the assist from left to right. It is to be understood that this same device can be used for raising or lowering vertically mounted windows. Simply put, the operator can position the wedge of handle 12 at the lower window lip, handle or recess so that the base sits on the window ledge. Then, by pushing or merely pressing down, the air seal can be broken and the lower window lifted with greater ease and much less operator effort.

Figure 6:
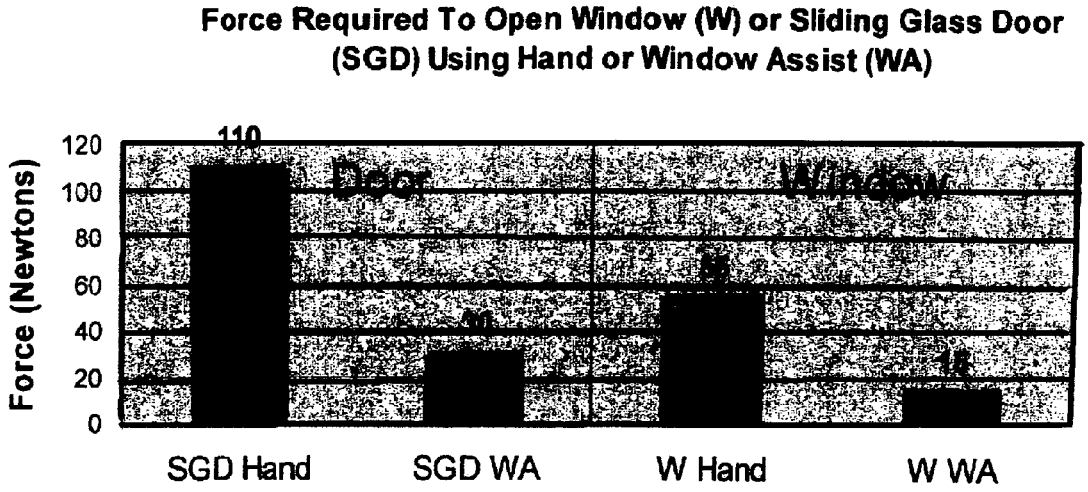
FIG. 6 is a graph depicting the reduced amount of force needed to open a sliding door or window using the invention.

Referring now to FIG. 6, there is shown with statistical evidence the degree to which door or window opening forces are reduced using the manual assist of this invention. Particularly, with a standard load cell (force meter), the amount of force needed to open a sliding glass door, then a sliding window in its frame was measured when opened by hand, or when opened using the manual assist of the invention. Each experiment was repeated three times. The results are shown in the comparative graph at FIG. 6. From those experiments, it was shown that the invention opened a sliding glass door with less than 30% of the effort (as measured in Newtons) required to open the very same door by hand, i.e., without the manual assist of this invention. The same percentage of effort reduction (nearly 30% needed) was measurably observed when opening the same, horizontally sliding window by hand versus with the manual assist of this invention.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A manual assist for opening a mechanism that slides in a preset track, said mechanism having a protruding edge or recessed area near a structural surround for the mechanism, said assist comprising:

(a) an elongated handle that is beveled to a preset degree, said elongated handle including a hook;

(b) a generally trapezoidal wedge with a substantially circular aperture in a central portion, said wedge attached near one end of the handle for situating between the protruding edge or recessed area of the mechanism and the structural surround adjacent same; and (c) a base pivotally yet permanently mounted to the handle near the wedge end and mounted proximal of a fulcrum, said base having a cushioned bottom and being configured to position either vertically or horizontally against the structural surround and slide open the mechanism when the handle and situated wedge are moved toward the structural surround.

2. The manual assist of claim 1 wherein the mechanism slides substantially horizontally in the preset track.

3. The manual assist of claim 1 wherein the handle is telescopically extendable.

4. The manual assist of claim 1 wherein the handle, wedge and base are made from wood, polymer, metal, plastic, graphite, composite or combinations thereof.

5. The manual assist of claim 4 wherein the handle is made from oak.

6. The manual assist of claim 4 wherein the wedge is made from plastic.

7. A sliding window opener assist for a sliding window having a protruding section or recessed area adjacent a structural frame for the window, said sliding window assist comprising:

(a) an elongated handle that is beveled to a preset degree, said elongated handle including a hook;

(b) a generally trapezoidal wedge with a substantially circular aperture in a central portion, said wedge attached near one end of the handle for positioning between the protruding section or recessed area and the structural frame; and (c) a base pivotally yet permanently mounted to the handle nearer the wedge end and mounted proximal of a fulcrum, said base having a cushioned bottom and being configured to position against the structural frame either vertically or horizontally and slide open the window when the handle and situated wedge are moved toward the structural frame.

8. The sliding window assist of claim 7 wherein the handle and base are made from wood, metal, ceramic, polymer, plastic or combinations thereof.

9. The sliding window assist of claim 7 wherein the handle and wedge are made from the same material, wood, metal, ceramic, polymer or plastic.

10. The sliding window assist of claim 7 wherein the handle section of the window includes a protruding edge or recessed area and the wedge has at least one straight edge for contacting with the window lip, handle or recessed area.

11. The sliding window assist of claim 7 wherein the handle is telescopically extendable.

12. A method for assisting with the opening of a sliding door or window in a first direction, said method comprising:

(a) providing a manual assist having an elongated handle that is beveled to a preset degree and includes a hook, said manual assist further including: a generally trapezoidal wedge near one end, said wedge having a substantially circular aperture in a central portion; and a pivotally yet permanently mounted base near the wedge end, said base being mounted proximal of a fulcrum and having a cushioned bottom;

(b) positioning said manual assist with the wedge adjacent a handle, raised lip or recessed area on the door or window being opened;

(c) locating the base of the manual assist either vertically or horizontally against a section of wall adjacent the handle, raised lip or recessed area of the door or window; and (d) levering the handle of the manual assist in a direction opposite the first direction of door or window opening.

* * * * *